United States Patent [19]

Herschler et al.

[11] Patent Number: 4,945,791

[45] Date of Patent: Aug. 7, 1990

[54] ELECTRICAL CONNECTOR BACKSHELL TORQUE TOOL

[75] Inventors: Wilbert H. Herschler, Lomita; Charles H. Westmoreland, deceased, late of Compton; by Dorothy J. Westmoreland, heir, all of Calif.

[73] Assignee: Rockwell International Corporation, El Segundo, Calif.

[21] Appl. No.: 267,479

[22] Filed: Nov. 4, 1988

[51] Int. Cl.[5] ..... B25B 13/04

[52] U.S. Cl. ..... 81/120; 81/124.2; 81/3.4

[58] Field of Search ..... 81/120, 121.1, 124.2, 81/122, 123, 3.43, 3.4

[56] References Cited

U.S. PATENT DOCUMENTS 4,552,040 11/1985 Bang ..... 81/65

4,749,251 6/1988 Moulin ..... 81/124.2

*Primary Examiner*—D. S. Meislin

*Assistant Examiner*—Lawrence Cruz

*Attorney, Agent, or Firm*—Charles T. Silberberg; Harold C. Weston

[57] ABSTRACT

A tool used for applying specified torque to the backshells of electrical connectors has a cylindrical body of diameter compatible with that of the backshell on which it is used with a cutout on said cylindrical body to allow wires from the connector to be routed away from the tool. A high friction material such as silicone rubber or similar type substance is bonded to the inner lower lip of the tool, below the cutout section, and a clamping means with separable closure and adjustable friction producing strap is bonded to the outer lower lip of the tool across its rear surface and over the front of said cutout. A fitting at the top of the tool is located on the tool's axis and is designed to accept conventional socket torque wrenches.

5 Claims, 1 Drawing Sheet

ELECTRICAL CONNECTOR BACKSHELL TORQUE TOOL

ORIGIN OF INVENTION

"This invention was made with Government support under contract no. F33657-81C-0210, awarded by the United States Air Force. The Government has certain rights in this invention."

BACKGROUND OF THE INVENTION

1. Field of the Invention

This tool relates to torque wrenches and particularly to means for assuring proper torque setting of the backshells of electrical connectors installed in functional systems. To overcome difficulties in state-of-the-art strap wrench techniques used for such torque setting (see FIG. 1), where off-center wrench application often provides erroneous readings and results in slippage of contact surfaces, the disclosed tool was developed to fit snugly around the backshell, with open cut means to allow wires from the subjacent connector to be routed out the cutout section and with strap means to grip the circumference of the backshell after closure of the strap and after its adjustment for gripping the backshell.

2. Description of the Prior Art

Search of the prior art related to this invention showed the strap wrench means of FIG. 1 and unrelated technology such as U.S. Pat. No. 4,393,583 to H.J. Zwald for an ANTI-TORQUE CONNECTION APPARATUS and a 1931 Pat. No. 1,972,239 to W. Rose for a CONDUIT WRENCH. The within tool is not comparable in function with either of the above inventions but certain of its elements do present themselves therein.

SUMMARY OF THE INVENTION

The electrical connector backshell torque tool described herein provides significant improvements over state-of-the-art strap wrenches for application of precise torque settings to such backshells. Backshells are used in electrical connectors to compress an elastic filler in the connector body and secure the pins or sockets connected to wires extending from the body to their functional terminals. All such conductors pass through the connector backshell which mates with the threaded male shell of the connector body to compress the connector's elastic filler around its pins or sockets. Accurate torque application is necessary to preclude under or over compression of the connector filler with consequences of loss of electrical contact at its pins or sockets, or distortion of the same through overtightening. The within torque tool utilizes a metallic tube segment (for example, T6 aluminum of 0.049 thickness and an inside diameter compatible with the backshell's outer diameter) about 5 to 7 inches long with a cutout section at its lower end, generally about half its diameter at the bottom and allowing about 3½ to 4 inches for routing of the wire bundle through the backshell to be torqued.

A strap means is banded to the lower lip by welding or other coupling means and situated to run across the open lip at the tool's cutout. This strap means is provided a base claw-like talon bonded to the tool body. Threaded screw means are used, in conjunction with a pin and nut to compress said pin into the claw-like talon by tightening the nut behind the pin.

Since backshells are usually knurled for help in securing the same, the inside of the lower lip of the tool is fitted with friction material such as silicone rubber or other moldable, shapeable friction producing material. The nut means used with the strap arrangement is uncoupled from the talon socket and, after the backshell is tightened by conventional strap wrench techniques to the approximate torque setting specified, the tool is placed over the backshell, its wire bundle routed through the slot and the strap fastened across the lower lip by tightening the pin into its talon fitting to provide a friction base between the tool and the backshell.

A socket on the central axis and at the upper end of the tool is used to accept a torque wrench which is then activated to apply proper coupling of the backshell to its connector body.

Should the preliminary strap wrench torquing of the backshell to the connector not be sufficient to provide for tightening of the backshell without strain on the conductors through the tool slot, it may be necessary to loosen the nut of the strap means and reposition the tool around the backshell for proper torque setting.

Primary use of the within torque tool is to provide a means for accurately coupling backshells to electrical connector bodies and to overcome difficulties experienced with slippage and off axis torquing resulting from strap wrench techniques presently in use. Accordingly, a primary object of this invention is to provide a tool allowing for axial application of coupling torque to an electrical connector's backshell.

A second object is to provide a better means of securing pins and sockets in the deformable filler bodies of electrical connectors through precise torque settings of their backshells to their connector bodies. Various strapping means and other coupling means to connect the tool to a knurled backshell are contemplated by this invention but its principle objective is to provide a means for applying coupling torque along the axis of coupling between a backshell and connector body.

DESCRIPTION OF THE PREFERRED EMBODIMENT

Figure 1:
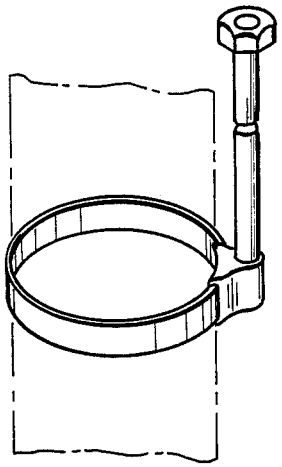
FIG. 1 PRIOR ART
FIG. 1 is a perspective view of a prior art strap wrench tool.
Figure 2:
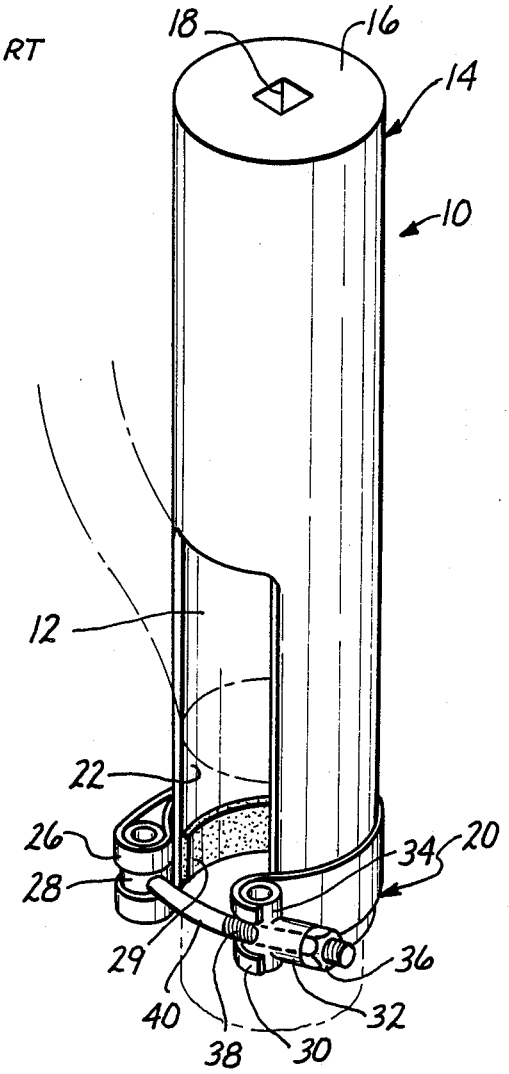
FIG. 2 presents the disclosed tool in its entirely, partly in phantom.
Figure 3:
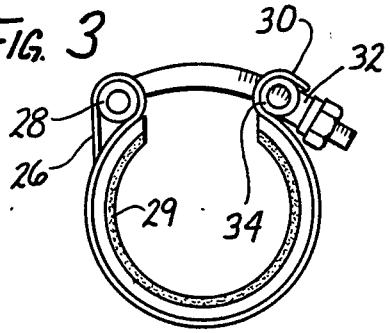
FIG. 3 presents a bottom view of the strap means used to secure the tool to its backshell workpiece.

A deformation resistant tubular element 10 of selectable dimensions and of suitable material (such as stainless steel, T6 aluminum, etc.) is machined so that an elongated slot is made, parallel to the tube axis, at its lower end, hereafter referred to as cut out 12, approximately half the length of element 10 and with a width of such slot equal to approximately half its diameter. The lower end of cutout 12 is at the base of the tool. At the upper end 14 of element 10 is a plug 16, bonded firmly to element 10 and provided with a fitting 18 suitable for insertion of torque wrench means. Fitting 18 is positioned on the central axis of the tool.

At the tool's lower end 20, on the inner surface 22 thereof, is bonded a friction material 29 such as rubber or silicone compound. On the outer surface of 20, a strap means is bonded, preferably around the entire surface with anchor means 26 welded or bonded to one side of cutout 12 there. Such anchor means 26 may be a simple restraining socket for a solid bolt fitting 40 or may be a fixed terminal for other flexible or removeable strap means. The preferred embodiment of FIG. 1 uses a bolt-like member 40 with its head 28 locked inside anchor means 26 and its body free to move about an axis through anchor 26.

On the alternate side of cutout 12 at base end 20, a claw-like socket 30 is coupled firmly to the body of element 10. A pin and coupling piece 32 is designed so that pin 34 is seatable in socket 30 when driven there by nut 36 along threaded portion 38 of bar 40.

In use, nut 36 is backed off threaded portion 38 to allow placement of the tool around a backshell. Bar 40 is then positioned so that nut 36 drives coupling piece 32 and its pin 34 tightly against talons 30. Wires from the connector body shall have been routed through cutout 12 prior to connecting bar 40 to talons 30. Nut 36 is then tightened so that friction material 29 is firmly compressed between the backshell and inner surface 22 of the tool. Care and reason must be exercised here to preclude overstressing the backshell. Only enough stress should be applied to allow no slippage between the tool and the backshell as prescribed torque is applied at socket 18.

Torque is then applied to the tool by a wrench at fitting 18, and proper torque established for coupling the backshell to its connector body.

Although a solid bar 40 has been proposed in the preferred embodiment, with talon 30, pin 34 and nut 36 called out to provide friction between the tool and its backshell workpiece, other strapping means are contemplated including screw driver activated drivers in a slotted belt or other flexible coupling means.

What is claimed is:

1. An electrical connector backshell torque tool, comprising: a cylindrical shell of suitable material, of selectable length and thickness, with an inner and outer surface, anchor means, retainer means, and an internal diameter slightly larger than the external diameter of an electrical connector backshell;

said cylindrical shell having a central axis and an upper and a lower portion, each of said portions having an upper and a lower end thereof;

said upper portion having its upper end fitted with a plug and socket means, said socket means dispositioned along said central axis;

said lower end of said upper portion and said upper end of said lower portion being integral;

said lower portion having a slot therein, said slot comprising a void of said suitable material, said void having first and second generally vertical edges and a horizontal edge coincident with said lower end of said upper portion;

said anchor means, for anchoring one end of a bar means, mounted on said outer surface near said lower end of said lower portion adjacent said first generally vertical edge;

said retainer means, for retaining another end of said bar means, dispositioned near said lower end of said lower portion adjacent said second generally vertical edge; and said bar means positionable between said anchor means and said retainer means;

said bar means fitted with tension adjustment means allowing forces between said anchor means and said retainer means to be controlled as necessary, wherein actuation of said tension adjustment means results in compression of said cylindrical shell around said backshell for applying torque to said backshell.

2. The tool of claim 1 including friction surfaces bonded to said inner surface of said cylindrical shell at the lower end of said lower portion.

3. The tool of claim 1 wherein said bar means comprises a threaded bar, with anchor means at one end of said threaded bar allowing said bar limited freedom to move about an axis parallel to the central axis of said cylindrical shell at the lower end of said lower portion.

4. The tool of claim 3 wherein said threaded bar is coupled to pin means and threaded nut means, said nut means blocking motion of said pin means and forcing said pin means lengthwise along said threaded bar.

5. The tool of claim 4 wherein said retainer means comprises talon claw means, said talon claw means coupled fixedly to said cylindrical shell and secured to said shell at the lower end of said lower portion on said second generally vertical edge of said slot.

* * * * *